US011134787B2

(12) United States Patent
Couture

(10) Patent No.: US 11,134,787 B2
(45) Date of Patent: Oct. 5, 2021

(54) ANTI-SHEARING AND ANTI-CRUSHING DEVICE ON A RETRACTABLE BED

(71) Applicant: BESTAR INC., Lac Mégantic (CA)

(72) Inventor: Alain Couture, Frontenac (CA)

(73) Assignee: BESTAR INC., Lac-Megantic (CA)

( * ) Notice: Subject to any disclaimer, the term of this patent is extended or adjusted under 35 U.S.C. 154(b) by 0 days.

(21) Appl. No.: 16/405,225

(22) Filed: May 7, 2019

(65) Prior Publication Data

US 2019/0350373 A1 Nov. 21, 2019

Related U.S. Application Data

(60) Provisional application No. 62/672,128, filed on May 16, 2018.

(51) Int. Cl.
*A47C 17/38* (2006.01)
*A47C 17/86* (2006.01)

(52) U.S. Cl.
CPC ..... *A47C 17/38* (2013.01); *A47C 17/86* (2013.01)

(58) Field of Classification Search
CPC ..... A47C 17/38; A47C 17/86; A47C 17/40; A47C 17/46; A47C 17/52; A47C 17/58; A47C 17/60
See application file for complete search history.

(56) References Cited

U.S. PATENT DOCUMENTS 1,359,337 A * 11/1920 Culbertson ..... A47C 17/46 5/133
1,723,649 A * 8/1929 Heath ..... A47C 17/46 5/140
2,105,236 A * 1/1938 Skobel ..... A47C 17/46 5/137
2,116,698 A 5/1938 Hall
2,222,222 A 11/1940 Dennis
(Continued)

FOREIGN PATENT DOCUMENTS

CA 2270614 A1 11/2000
CA 2320735 A1 3/2002
(Continued)

*Primary Examiner* — Nicholas F Polito
*Assistant Examiner* — George Sun
(74) *Attorney, Agent, or Firm* — Fasken Martineau DuMoulin

(57) ABSTRACT

A retractable bed comprising a fixed structure comprising a pair of side walls and a bed-receiving space between the side walls, a displaceable bedbase removably storable in the bed-receiving space, wherein at least one clearance is maintained between the displaceable bedbase and one of the side walls, and at least one flap hingedly mounted to the fixed structure by at least one spring-loaded hinge, wherein in a closed position the displaceable bedbase is stored in the bed-receiving space and the at least one flap is fully closed and blocking access to the at least one clearance, and wherein in an open position the displaceable bedbase is removed from the bed-receiving space and the at least one flap is fully open and allowing access to the clearance, the at least one hinge preventing the at least one flap from closing until the displaceable bedbase is fully returned to the bed-receiving space.

8 Claims, 6 Drawing Sheets

(56) References Cited

U.S. PATENT DOCUMENTS

| | | | | |
|---|---|---|---|---|
| 2,640,203 | A * | 6/1953 | Sheldon | A47C 17/46 5/100 |
| 3,945,157 | A | 3/1976 | Borys | |
| 4,766,623 | A | 8/1988 | Beinhoffer et al. | |
| 4,950,123 | A | 8/1990 | Brockhaus | |
| 5,033,134 | A * | 7/1991 | Burchett | A47C 17/52 5/133 |
| 5,036,558 | A | 8/1991 | Lameka et al. | |
| 5,052,878 | A | 10/1991 | Brockhaus | |
| 5,331,695 | A | 7/1994 | Bales | |
| 5,446,932 | A | 9/1995 | Voorhis | |
| 5,513,941 | A | 5/1996 | Kulas et al. | |
| 6,105,185 | A | 8/2000 | DiRocco | |
| 6,401,276 | B1 | 6/2002 | Sherman | |
| 6,574,807 | B1 * | 6/2003 | Gonzalez | A47C 17/58 5/149 |
| 6,698,040 | B1 | 3/2004 | Acevedo | |
| 6,820,293 | B2 | 11/2004 | Alverson | |
| 6,928,673 | B2 | 8/2005 | Risk, Jr. | |
| 7,144,058 | B1 | 12/2006 | Winter | |
| 7,472,920 | B2 | 1/2009 | Chai | |
| 7,552,486 | B2 | 6/2009 | Kaempfen | |
| 7,559,097 | B2 | 7/2009 | Brun | |
| 7,559,099 | B2 | 7/2009 | Epshetsky et al. | |
| 7,921,487 | B2 | 4/2011 | Stonier | |
| 7,937,787 | B2 * | 5/2011 | Whitford | A47C 17/46 5/139 |
| 8,136,181 | B2 | 3/2012 | Roepke | |
| 8,534,735 | B2 | 9/2013 | Mcmanus et al. | |
| 8,566,980 | B2 | 10/2013 | Grone | |
| 9,744,400 | B2 * | 8/2017 | Cole | A47B 81/00 |
| 2010/0043142 | A1 * | 2/2010 | Whitford | A47C 17/46 5/136 |
| 2014/0013678 | A1 | 1/2014 | Deverini | |
| 2015/0230620 | A1 * | 8/2015 | Guyvoronskiy | A47C 17/48 5/136 |
| 2016/0037934 | A1 * | 2/2016 | Porter | A47C 17/58 5/174 |
| 2016/0084000 | A1 * | 3/2016 | Schlanker | A47C 17/38 5/136 |
| 2016/0278532 | A1 | 9/2016 | Wilson | |
| 2016/0324326 | A1 | 11/2016 | Mccoy | |
| 2017/0007028 | A1 * | 1/2017 | Grubb | A47C 17/52 |
| 2017/0007029 | A1 * | 1/2017 | Grubb | A47C 17/52 |

FOREIGN PATENT DOCUMENTS

| | | | |
|---|---|---|---|
| CA | 2635954 | A1 | 7/2007 |
| DE | 4238226 | A1 | 7/1993 |
| DE | 4323911 | A1 | 1/1995 |
| DE | 10328203 | B4 | 4/2004 |
| DE | 202008009355 | U1 | 11/2009 |
| DE | 202012010980 | U1 | 11/2012 |
| DE | 102015204699 | A1 | 10/2015 |
| EP | 0803212 | B1 | 12/2001 |
| EP | 1584268 | A2 | 10/2005 |
| EP | 2380462 | B1 | 9/2013 |
| FR | 2538846 | A1 | 7/1984 |
| FR | 2723136 | B1 | 9/1996 |
| FR | 2751370 | B1 | 9/1998 |
| FR | 2726317 | B1 | 9/1999 |
| FR | 2865761 | B3 | 9/2006 |
| FR | 2930583 | B1 | 1/2013 |
| JP | H0586709 | A | 4/1993 |
| JP | H06136927 | A | 5/1994 |
| JP | H06136928 | A | 5/1994 |
| JP | H06136929 | A | 5/1994 |
| JP | H06346538 | A | 12/1994 |
| JP | H0776977 | A | 3/1995 |
| JP | H07300974 | A | 11/1995 |
| JP | H0821060 | A | 1/1996 |
| JP | H0821061 | A | 1/1996 |
| JP | H08257154 | A | 10/1996 |
| JP | H0941650 | A | 2/1997 |
| JP | H0978859 | A | 3/1997 |
| JP | H09287268 | A | 11/1997 |
| JP | 3051566 | U | 8/1998 |
| JP | H11124926 | A | 5/1999 |
| JP | 2964225 | B2 | 10/1999 |
| JP | 2000220273 | A | 8/2000 |
| JP | 2000274043 | A | 10/2000 |
| JP | 2001164678 | A | 6/2001 |
| JP | 2001200624 | A | 7/2001 |
| JP | 2002021318 | A | 1/2002 |
| JP | 3448739 | | 9/2003 |
| JP | 2004081318 | A | 3/2004 |
| JP | 3659363 | B2 | 6/2005 |
| JP | 3966396 | B2 | 8/2007 |
| JP | 3981891 | B1 | 9/2007 |
| JP | 4085296 | B2 | 5/2008 |
| JP | 2008121408 | A | 5/2008 |
| JP | 2008208628 | A | 9/2008 |
| JP | 2008208662 | A | 9/2008 |
| JP | 3189237 | B2 | 7/2011 |
| JP | 4855848 | B2 | 1/2012 |
| JP | 5035836 | B2 | 9/2012 |
| WO | 1985003628 | A1 | 8/1985 |
| WO | 1990012945 | A1 | 11/1990 |
| WO | 2001049149 | A2 | 7/2001 |
| WO | 2007082801 | A1 | 7/2007 |
| WO | 2012034461 | A1 | 3/2012 |
| WO | 2016049482 | A1 | 3/2016 |

* cited by examiner

ANTI-SHEARING AND ANTI-CRUSHING DEVICE ON A RETRACTABLE BED

CROSS REFERENCE TO RELATED APPLICATION

This application claims benefit, under 35 U.S.C. § 119(e), of U.S. provisional application Ser. No. 62/672,128, filed on May 16, 2018, which is incorporated herein in its entirety by reference.

FIELD OF THE INVENTION

The present invention relates to safety devices and methods for a retractable bed, and more particularly to safety devices and methods to reduce or eliminate the various risks associated with retractable beds as they move between their various positions.

BACKGROUND OF THE INVENTION

Retractable beds such as foldaway beds have been used for many years to provide both temporary sleeping accommodations and more permanent sleeping accommodations in limited spaces. Traditional retractable beds typically include a movable bed platform or bedbase pivotally connected to a fixed frame, thus presenting various risks of injury to the person manipulating the bed as well as anyone in the vicinity of the bed. These risks may include shearing and crushing of their fingers or other parts of their body. These risks of injury are of particular concern for children, who may not be aware of the potential dangers. There are also risks of damage to various objects located nearby while the retractable bed is being manipulated.

When in their retracted positions, most retractable beds are stored in a piece of furniture or a frame in which the space between the movable and fixed sections is reduced to a minimum for both functional and aesthetic purposes. Due to this limited spacing, there is a high risk that a finger, hand, or other body part becomes trapped between the movable section and the fixed section of the retractable bed as it is manipulated, for example from a horizontal to vertical position. These risks are especially high when the user holds the movable section by its edges or when an additional person, a pet or an object is nearby during this manipulation, creating a hazardous environment.

These risks may be reduced by increasing the space between the movable bedbase and the fixed frame, as well as by simply eliminating the vertical frame from the retractable bed. However, these modifications would require significant alterations to the mechanisms and structures of retractable beds, and would have a negative impact on their aesthetics, thus reducing their consumer appeal.

The above-discussed issues have been mentioned in the International Standard ISO 10131-1: 1997: Foldaway beds—Safety Requirements and Tests, outlining various standards in the field of retractable beds. As such, there is a need for a safety device that eliminates the risks of injuries or other damage normally associated with retractable beds, particularly during their transitions between their horizontal and vertical positions. There is also a need for such a device to be largely unnoticeable when the retractable bed is in a retracted or stowed position.

SUMMARY OF THE INVENTION

In order to address the above and other drawbacks, there is provided a retractable bed comprising a fixed structure comprising a pair of side walls and a bed-receiving space between the side walls, a displaceable bedbase removably storable in the bed-receiving space, wherein at least one clearance is maintained between the displaceable bedbase and one of the side walls, and at least one flap hingedly mounted to the fixed structure by at least one spring-loaded hinge, wherein in a closed position the displaceable bedbase is stored in the bed-receiving space and the at least one flap is fully closed and blocking access to the at least one clearance, and wherein in an open position the displaceable bedbase is removed from the bed-receiving space and the at least one flap is fully open and allowing access to the clearance, the at least one spring-loaded hinge preventing the at least one flap from closing until the displaceable bedbase is fully returned to the bed-receiving space.

In an embodiment, the retractable bed further comprises a bedbase cover, the bedbase cover covering the displaceable bedbase so that it sides sit against each flap in the closed position.

In an embodiment, the at least one flap comprises a recess for manually moving the flap in the open position.

In an embodiment, the at least one flap overlaps a corner of the displaceable bedbase in the closed position such that the corner abuts and urges the at least one flap to open as the displaceable bedbase is removed from the bed-receiving space.

In an embodiment, the displaceable bedbase comprises a mattress support.

In an embodiment, the mattress support comprises a plurality of slats.

In an embodiment, the displaceable bedbase is connected to the fixed structure by an assist device, the assist device configured to assist the removal and storage of the displaceable bedbase in the bed-receiving space.

In an embodiment, the assist device comprises a gas spring or a mechanical spring.

There is also provided a safety device for a retractable bed comprising a fixed structure and a displaceable bedbase removably storable in a bed-receiving space of the fixed structure defined by a pair of side walls, the safety device comprising at least one flap hingedly mounted to one of the side walls of the fixed structure by at least one spring-loaded hinge, the at least one flap openable and closable to selectively allow and block access to a clearance maintained between the displaceable bedbase and one of the side walls, wherein when the at least one flap is open, the at least one spring-loaded hinge biases the at least one flap to maintain access to the clearance until the displaceable bedbase is fully stored in the bed-receiving space.

In an embodiment, the at least one flap comprises a recess for manually moving said at least one flap (16) in an open position.

In an embodiment, the at least one flap overlaps a corner of the displaceable bedbase stored in the bed-receiving space such that the corner abuts and urges the at least one flap to open as the displaceable bedbase is removed from the bed-receiving space.

There is also provided a method for safely manipulating a retractable bed between a closed position in which a displaceable bedbase is stored in a bed-receiving space of a fixed structure and an open position in which the displaceable bedbase is removed from the bed-receiving space, the method comprising the steps of removing the displaceable bedbase from the bed-receiving space, a corner of the displaceable bedbase abutting and urging at least one flap to open and allow access to at least one clearance between the displaceable bedbase and a sidewall of the fixed structure, the opening assisted by at least one spring-loaded hinge connecting the at least one flap to the fixed structure, storing the displaceable bedbase in the bed-receiving space, wherein the at least one spring-loaded hinge biases the at least one flap to remain open until the displaceable bedbase is fully stored in the bed-receiving space, and closing the at least one flap when the displaceable bedbase is fully stored in the bed-receiving space, blocking access to the at least one clearance.

There is also provided a method for retrofitting a safety device to a retractable bed comprising a fixed structure and a displaceable bedbase removably storable in a bed-receiving space of the fixed structure defined by a pair of side walls, the method comprising hingedly mounting at least one flap to one of the side walls of the fixed structure with at least one spring-loaded hinge, the at least one flap openable and closable to selectively allow and block access to a clearance maintained between the displaceable bedbase and one of the side walls, wherein when the at least one flap is open, the at least one spring-loaded hinge biases the at least one flap to maintain access to the clearance until the displaceable bedbase is fully stored in the bed-receiving space.

Other objects, advantages and features of the present invention will become more apparent upon reading of the following non-restrictive description of specific embodiments thereof, given by way of examples only with reference to the accompanying drawings.

DETAILED DESCRIPTION

The present invention is illustrated in further details by the following non-limiting examples.

Figure 1:
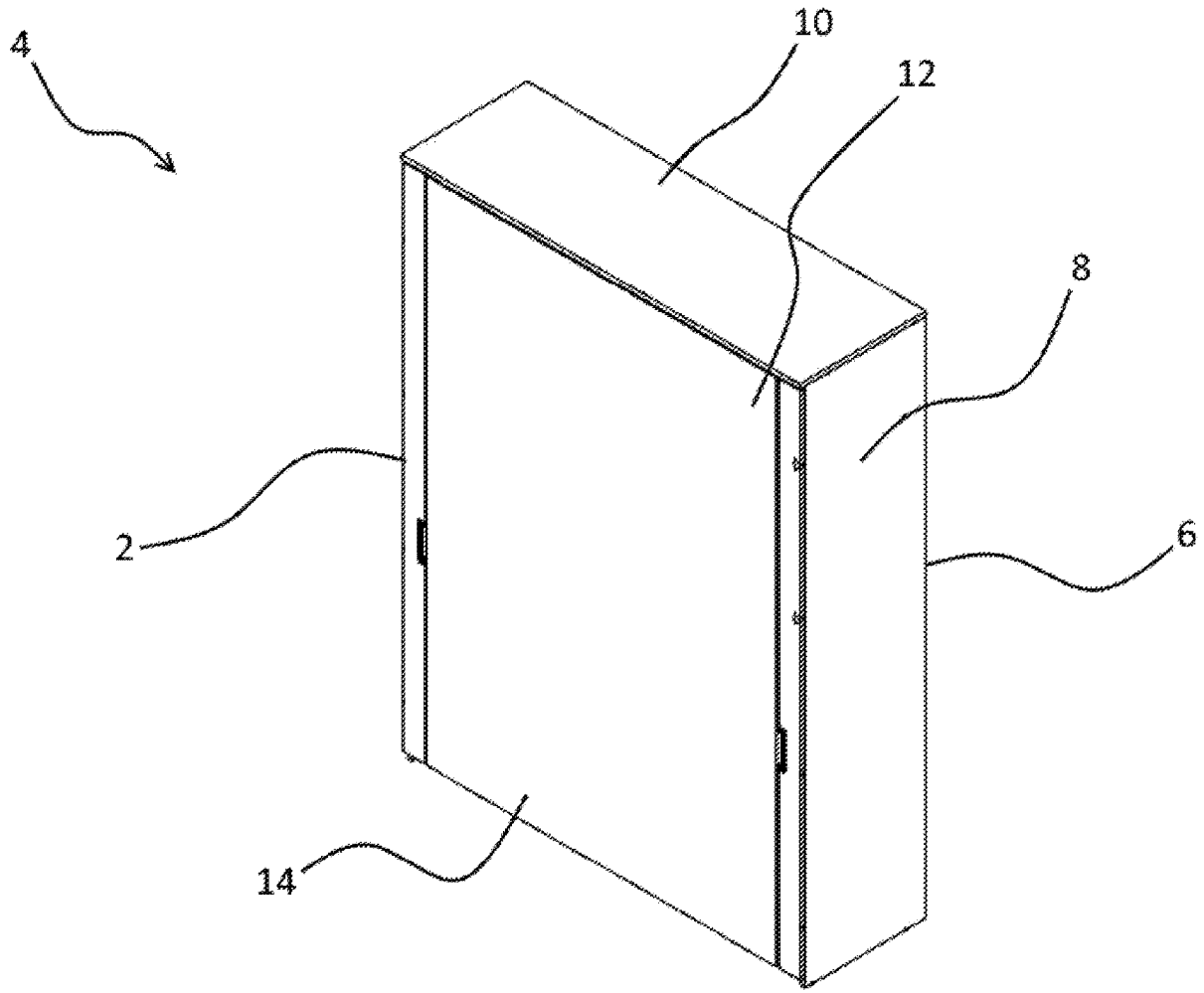
FIG. 1 shows a perspective view of a retractable bed comprising a safety device in a closed position, according to a preferred embodiment of the present invention.

Referring to FIG. 1, there is shown a safety device 2 for a retractable bed 4, according to a preferred embodiment of the present invention. As a person of skill in the art would understand, a variety of retractable beds 4 are available, such as pull-out sofa beds, wall or murphy beds, and folding rollaway beds. Retractable bed 4, shown in FIG. 1 as a wall bed in an closed position (stowed or retracted configuration), includes a fixed structure 6 which includes a pair of side walls 8 and a top panel 10 defining a bed-receiving space 12 in which a displaceable bedbase 14 is stowable. As will be discussed in further detail below, safety device 2 ensures that the bedbase 14 can be stowed in the bed-receiving space 12 of fixed structure 6 and subsequently removed from the bed-receiving space 12 in a safe and efficient manner while minimizing the risks of injury and damage to nearby people or objects.

Figure 2A:
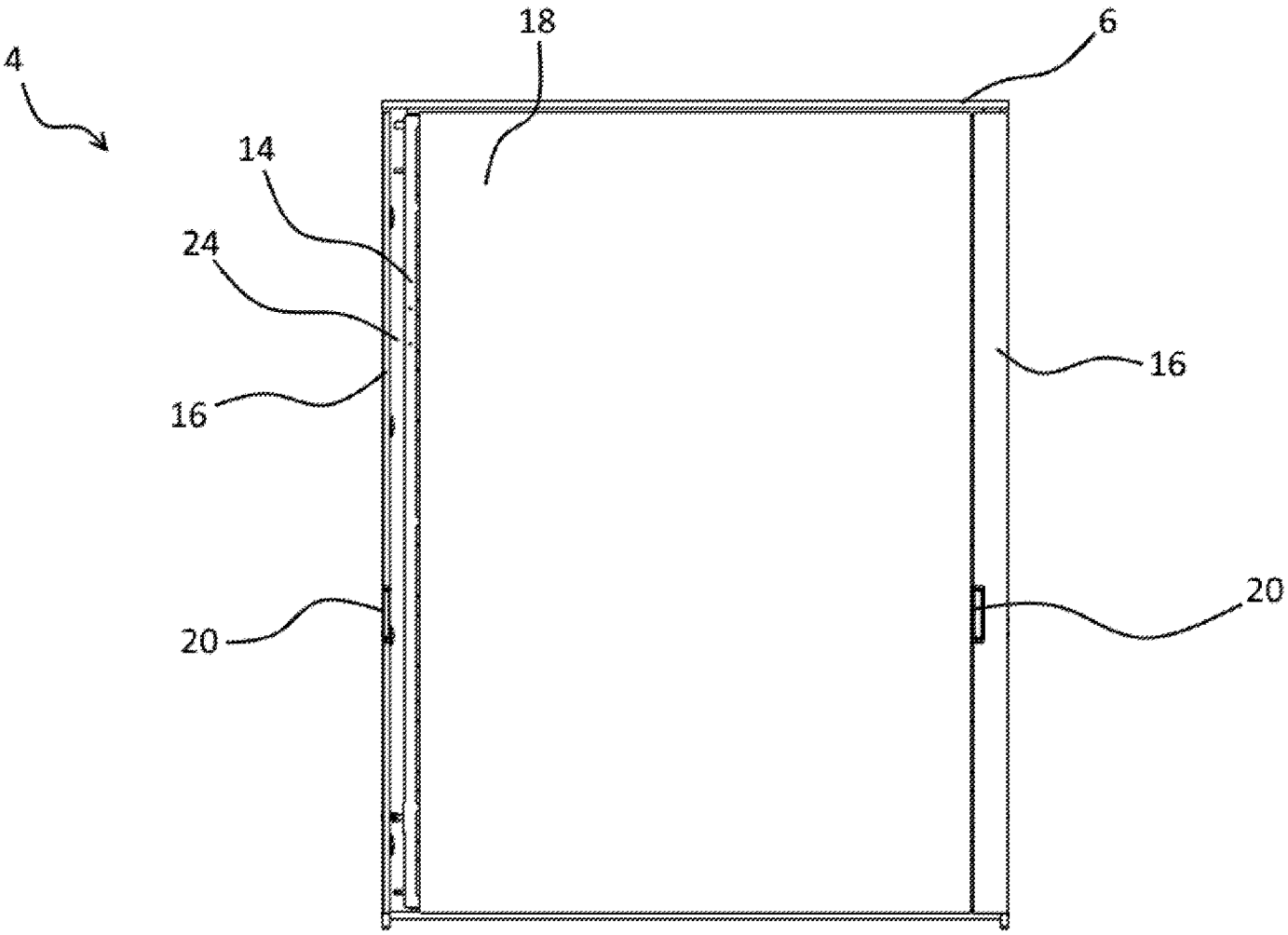
FIGS. 2A and 2B respectively show front and perspective views of the retractable bed of FIG. 1 with an open flap.
Figure 2B:
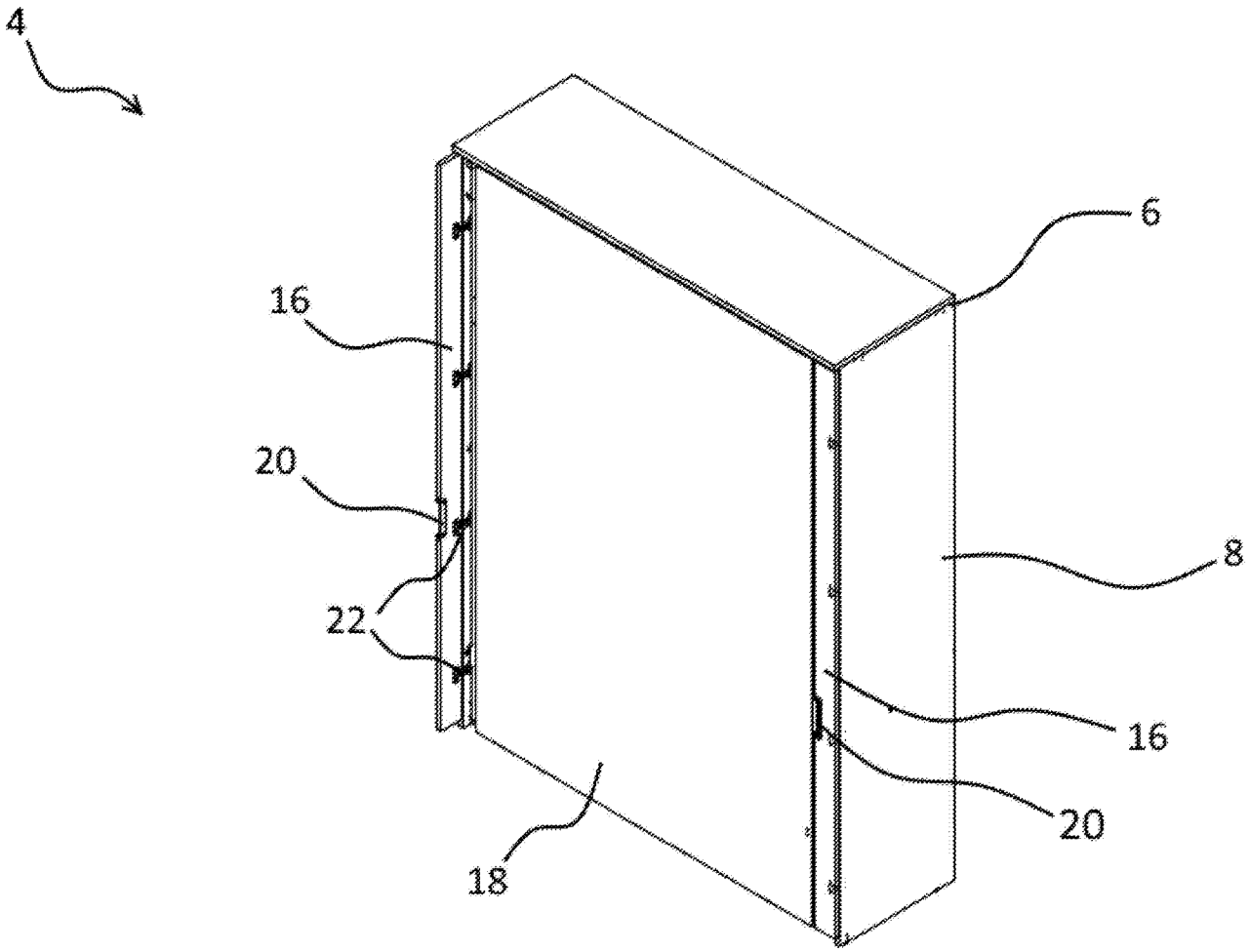

Referring now to FIGS. 2A and 2B, safety device 2 includes at least one flap 16 attached to either the fixed structure 6 or the displaceable bedbase 14, illustratively two flaps 16 arranged vertically on either side of the displaceable bedbase 14, each flap 16 hingedly attached to one of the side walls 8. Additionally, in an embodiment, a bedbase cover 18 covers displaceable bedbase 14 when it is in its stowed or retracted position, and each flap 16 may include a recess 20 for manually opening the flap 16. When the retractable bed 4 is in a stowed or retracted configuration, flaps 16 remain in a closed position, resting against displaceable bedbase 14 and sitting adjacent bedbase cover 18. As such, the closed flaps 16 block access to the potentially dangerous structural elements of the displaceable bedbase 14 that could cause various injuries to users, bystanders or nearby objects by shearing, crushing or pinching.

Figure 4A:
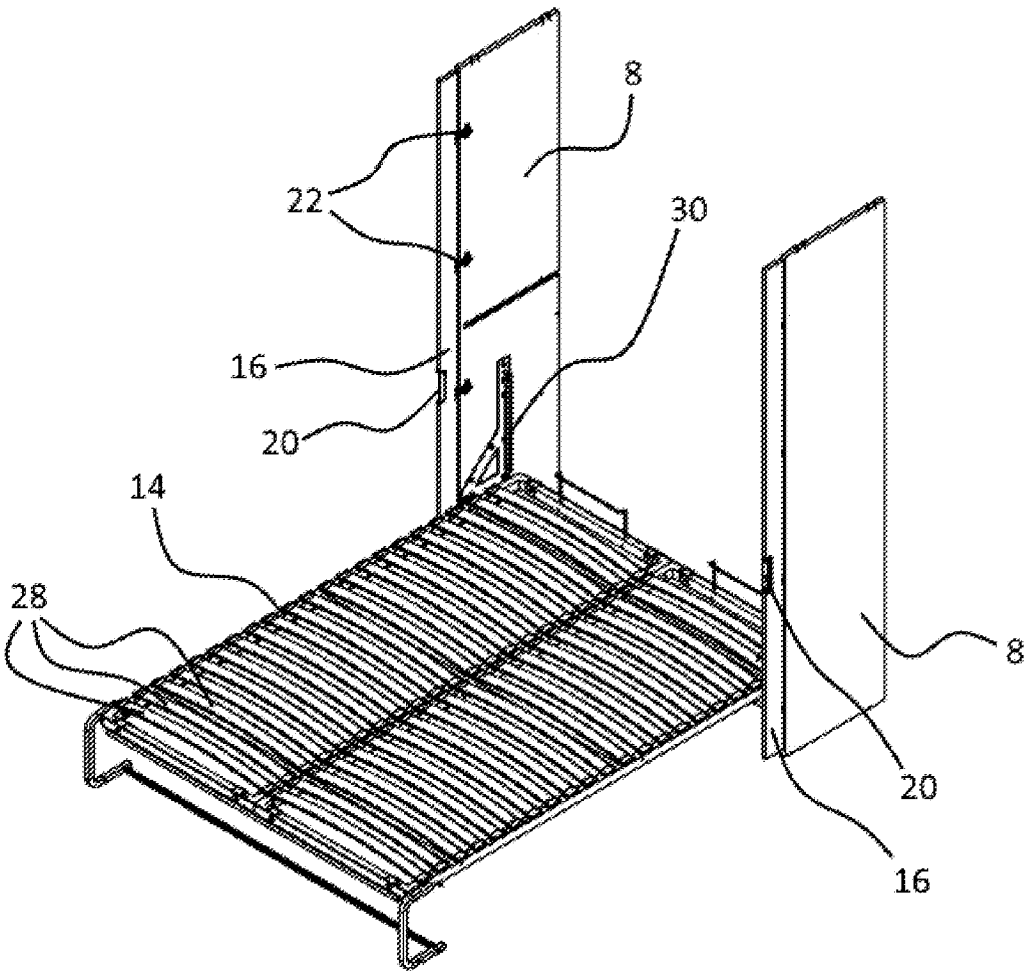
FIGS. 4A, 4B and 4C respectively show a perspective view, top view and magnified top view of the retractable bed of FIG. 1 in an open position with the top panel hidden.
Figure 4C:
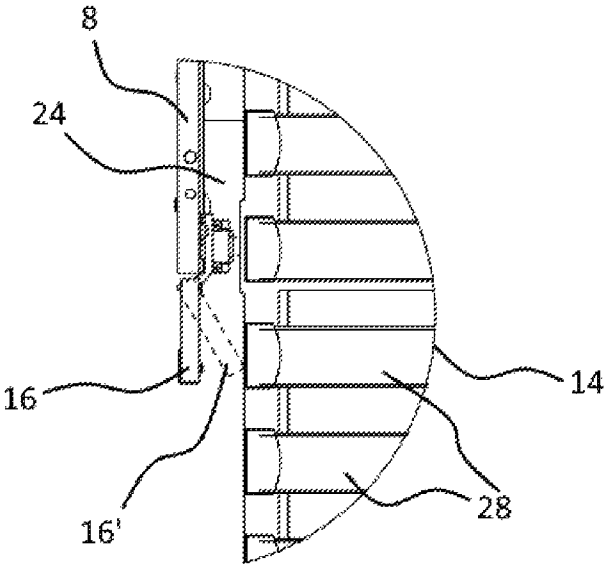
Figure 4B:
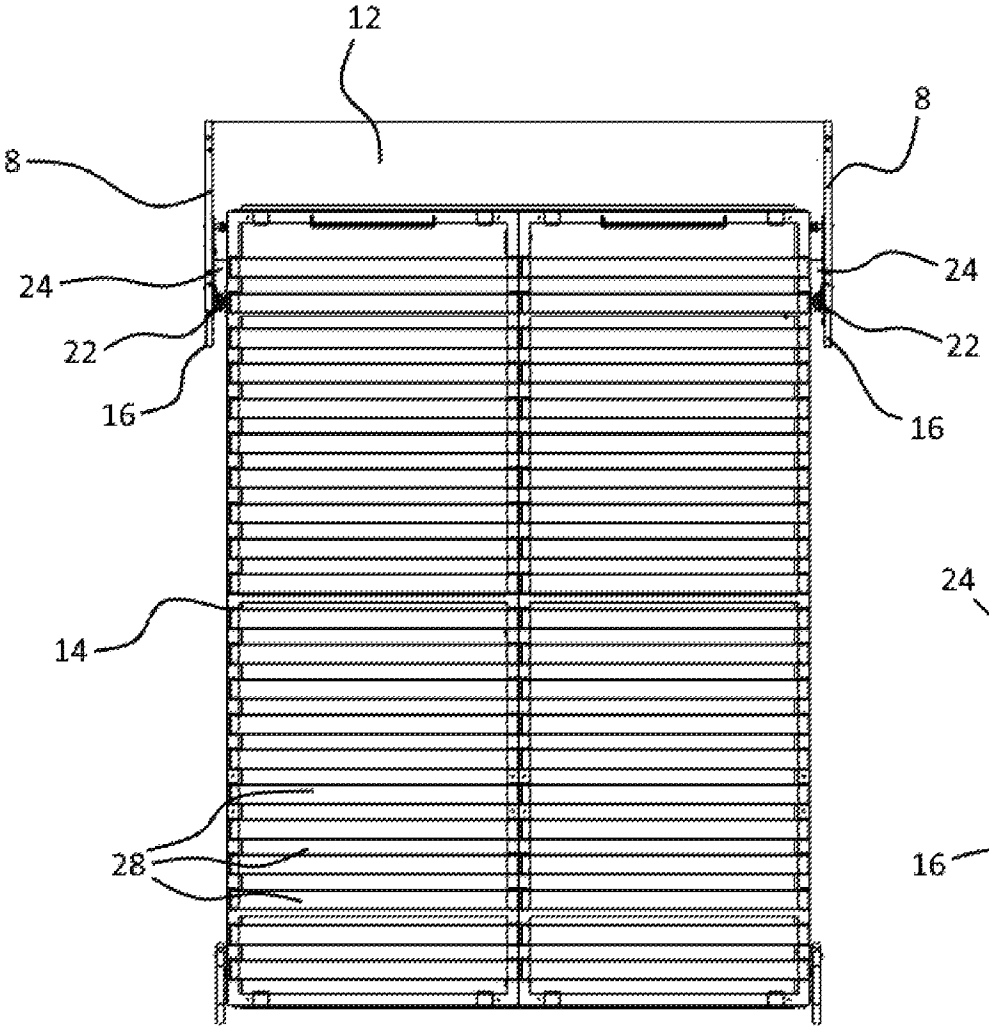

Still referring to FIGS. 2A and 2B, when a user intends to convert the retractable bed 4 from its closed, stowed or retracted configuration (with displaceable bedbase 14 illustratively a vertical or upright position) to an open or expanded configuration (with displaceable bedbase 14 illustratively in a horizontal position as shown in FIGS. 4A-4C), the at least one flap 16 is automatically opened, as will be discussed in further detail below. The flap 16 is maintained in such a configuration by at least one corresponding spring-loaded hinge 22 until the displaceable bedbase 14 is once again safely stowed in the bed-receiving space 12 of the fixed structure 6, at which point a user would manually close the at least one flap 16. In the example illustrated there are four spring-loaded hinges 22 per each flap 16, but other number of spring-loaded hinges 22 may be used depending on sizes and configurations. Preferably, the spring-loaded hinges open at about 110 degrees. When the at least one flap 16 is open, as shown by the left flap 16 in FIGS. 2A and 2B, at least one clearance 24 is maintained between the displaceable bedbase 14 and one of the side walls 8 of fixed structure 6 to minimize the risk of injury. In an embodiment, there is a clearance 24 between each side of the displaceable bedbase 14 and a corresponding side wall 8. The clearance 24 is preferably of about 40 mm or 1.6 inches.

Figure 3A:
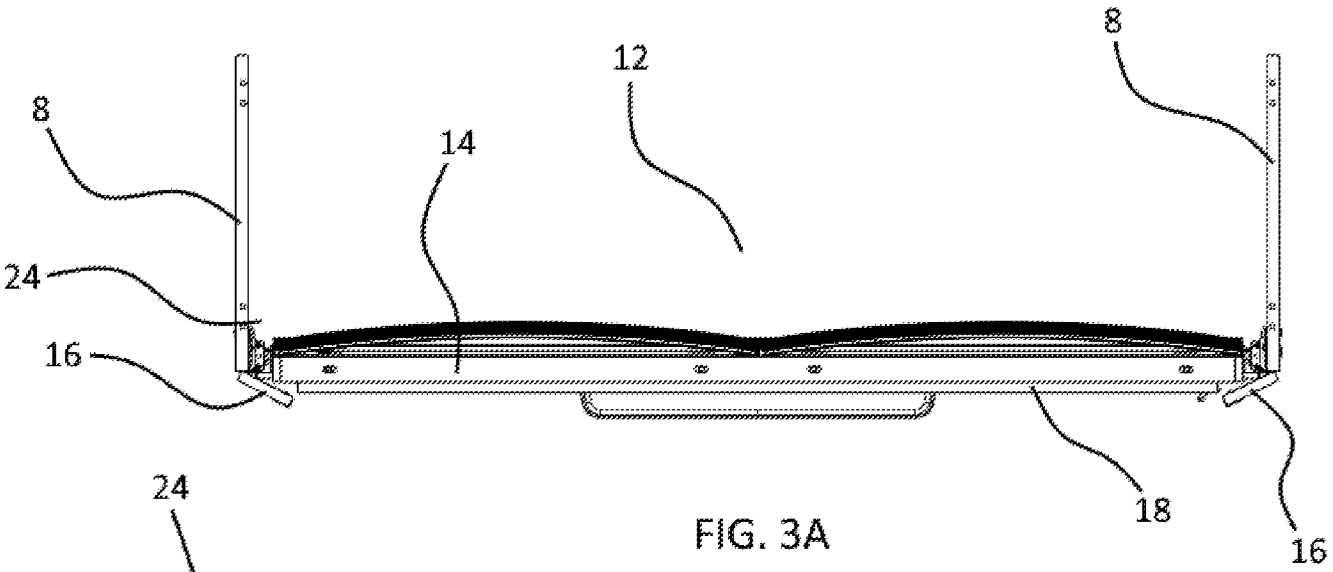
FIGS. 3A and 3B respectively show a top view and magnified top view of the retractable bed of FIG. 1 with two flaps partially open.
Figure 3B:
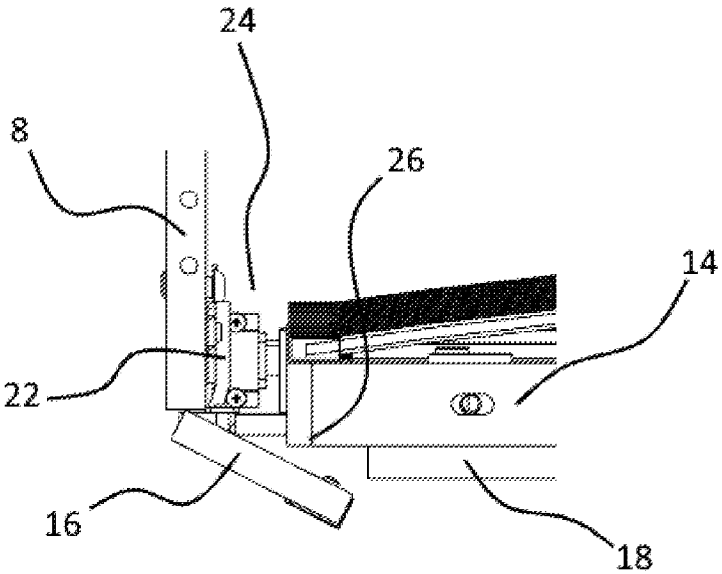

Referring now to FIGS. 3A and 3B, each flap 16 may be dimensioned such that its length is greater than the width of the clearance 24. As such, when the displaceable bedbase 14 is stowed in the bed-receiving space 12 of the fixed structure 6 and each flap 16 is closed, each flap 16 overlaps with a respective corner 26 of displaceable bedbase 14 and is adjacent bedbase cover 18. As such, when a user removes the displaceable bedbase 14 from the bed-receiving space 12, each corner 26 of displaceable bedbase 14 abuts a respective flap 16, thus causing each flap 16 to open simultaneously with the displaceable bedbase 14. As discussed above, once each flap 16 is open, it is maintained as such by corresponding spring-loaded hinge 22.

Referring now to FIGS. 4A to 4C, when the retractable bed 4 is in an open position whereby the displaceable bedbase 14 is fully removed from the bed-receiving space 12 of the fixed structure 6, each flap 16 is maintained in its fully opened position by the action of a corresponding spring-loaded hinge 22. In an alternate embodiment, a hinge with an external spring acting upon it may be used to maintain each flap 16 in its open position. While the displaceable bedbase 14 is withdrawn from the fixed structure 6, any attempt by a user to close a flap 16 will result in the flap 16 abutting the displaceable bedbase 14, as shown by semi-open flap 16' in FIG. 4C. In addition. as each spring-loaded hinge 22 exerts a constant force on a corresponding opened flap 16, semi-open flap 16' will simply revert back to its opened position once released by the user. As discussed above and shown in FIGS. 2A to 3B, each flap 16 blocks access to a corresponding clearance 24 when the displaceable bedbase 14 is stowed in fixed structure 6. In addition, when the displaceable bedbase 14 is in its open configuration, as shown in FIGS. 4A to 4C, the open flap 16 continues to block access to the clearance 24 from any person or object positioned adjacent to a corresponding sidewall 8. As a person of skill in the art would understand, the protection offered by each flap 16 negates the need for an unnecessarily wide clearance 24 that would cause the retractable bed 4 to occupy more space and render the retrofitting of safety system 2 on an existing retractable bed 4 difficult.

Still referring to FIGS. 4A to 4C, once fully removed from the fixed structure 6, displaceable bedbase 14 may accommodate a mattress (not shown), and thus may be configured as either a solid support platform or as a plurality of individual supports, illustratively a plurality of slats 28, to adequately support the mattress. In an embodiment, displaceable bedbase 14 is connected to the fixed structure 6 by at least one assist device 30, illustratively a gas spring or a mechanical spring, to assist the user in removing and replacing the displaceable bedbase 14 in the fixed structure 6. In an additional embodiment, bedbase cover may provide additional support to the displaceable bedbase 14 when it is used as a bed or seating surface.

As may be understood by a person skilled in the art, the present invention may operate in a plurality of configurations beyond what is described the above-mentioned embodiments. For instance, the safety device 2 may include at least one flap 16 installed on the retractable bed 4 either horizontally or vertically. Each flap 16 may be positioned on at least one side of the displaceable bedbase 14 in a vertical configuration, above the displaceable bedbase 14 in a horizontal configuration, or combinations thereof. The flaps 16 may be attached to either the fixed structure 6 or to the displaceable bedbase 14. In addition, the displaceable bedbase 14 may be dimensioned to accommodate a plurality of mattress sizes or additionally a variety of supportive or decorative items such as a seat, a bench, a stool, an armrest, a footstool, a table, or a desk. Furthermore, the various elements of the safety device 2 and retractable bed 4 may be fabricated from various materials such as woods and derivatives, metal, plastic, or rubber. The flaps 16 may be fabricated from various materials and be dimensioned to suit a variety of types of retractable beds 4. The spring-loaded hinges 22 or other suitable hinges with external springs may be of various types, forms, openings, and dimensions and their action may keep the flap either entirely open or entirely closed.

In an embodiment, the present disclosure also teaches a method for safely manipulating a retractable bed 4 between a closed position in which a displaceable bedbase 14 is stored in a bed-receiving space 12 of a fixed structure 6 and an open position in which the displaceable bedbase 14 is removed from the bed-receiving space 12. The first step of this method is removing the displaceable bedbase 14 from the bed-receiving space 12, a corner 26 of the displaceable bedbase 14 abutting and urging at least one flap 16 to open and allow access to at least one clearance 24 between the displaceable bedbase 14 and a sidewall 8 of the fixed structure 6, the opening assisted by at least one spring-loaded hinge 22 connecting the at least one flap 16 to the fixed structure 6. The next step is storing the displaceable bedbase 14 in the bed-receiving space 12, wherein the at least one spring-loaded hinge 22 biases the at least one flap 16 to remain open until the displaceable bedbase 14 is fully stored in the bed-receiving space 12. The last step of this method is closing the at least one flap 16 when the displaceable bedbase 14 is fully stored in the bed-receiving space 12, blocking access to the at least one clearance 24.

In another embodiment, the present disclosure also teaches a method for retrofitting a safety device 2 to a retractable bed 4 including a fixed structure 6 and a displaceable bedbase 14 removably storable in a bed-receiving space 12 of the fixed structure 6 defined by a pair of side walls 8. This method includes the step of hingedly mounting at least one flap 16 to one of the side walls 8 of the fixed structure 6 with at least one spring-loaded hinge 22, the at least one flap 16 openable and closable to selectively allow and block access to a clearance 24 maintained between the displaceable bedbase 14 and one of the side walls 8. When the at least one flap 16 is open, the at least one spring-loaded hinge 22 biases the at least one flap 16 to maintain access to the clearance 24 until the displaceable bedbase 14 is fully stored in the bed-receiving space 12.

The scope of the claims should not be limited by the preferred embodiments set forth in the examples, but should be given the broadest interpretation consistent with the description as a whole.

The invention claimed is:

1. A vertically retractable panel bed for movement of a retractable bed base and assorted sleeping mattress between a deployed horizontal position for sleeping and a retracted vertical position for temporary stowage and display, said retractable panel bed comprising: a frame comprising a pair of side walls and a top wall defining a inner space sized and shaped for receiving said retractable panel bed base and mattress while in vertical storage position while leaving a clearance gap between said frame walls and said retractable bed base, said retractable bed base having an inner surface for supporting said assorted sleeping mattress and an outer panel surface for displaying an outer panel when said retractable panel bed base is in a vertical retracted position in the space within said frame, wherein said frame has at least one flap hingedly mounted to a said side wall by at least one spring-loaded hinge allowing a closed-flap position when the bed is in retracted vertical position and a open-flap position when the bed is deployed horizontal position for sleeping; wherein said flap is sized and shaped to cover and bridge the clearance gap by partial overlap with the outer panel when in a closed-flap position and wherein said flap is automatically urged from fully closed to fully open into its open-flap position by contact with the retractable panel bed base when said retractable panel bed base is moved to the horizontal position for sleeping.

2. The vertically retractable panel bed of claim 1, wherein said at least one flap comprises a recess for manually moving said at least one flap.

3. The vertically retractable panel bed of claim 1, wherein said at least one flap overlaps a corner of said outer panel when in said closed-flap position.

4. The vertically retractable panel bed of claim 1, wherein said inner surface of said retractable panel bed base comprises a plurality of mattress supporting slats.

5. The vertically retractable panel bed of claim 1, wherein said retractable panel bed base is connected to said frame by an assist device configured to assist a deployment and stowage of said retractable bed base in said inner space.

6. The vertically retractable panel bed (4) of claim 5, wherein said assist device comprises a gas spring or a mechanical spring.

7. A safety device for a vertically retractable panel bed comprising a frame and a displaceable bed base removably storable in a bed-receiving space of the frame defined by a pair of side walls, the safety device comprising: at least one flap hingedly mounted to one of the side walls of the frame by at least one spring-loaded hinge, said at least one flap openable and closable to selectively allow and block access to a clearance gap maintained between the displaceable bed base and one of the side walls wherein said at least on flap being sized and shaped to cover said clearance gap by partial overlap on said displaceable bed base and wherein when said at least one flap is open, said at least one flap overlaps a corner of the displaceable bed base stored in the bed-receiving space such that said corner abuts and automatically urges from fully closed to fully open said at least one flap to open as the displaceable bed base is removed from the bed-receiving space, said at least one spring-loaded hinge biases said at least one flap is an open position to maintain said clearance gap access until the displaceable bed base is fully stored in the bed-receiving space at which point the spring-loaded hinge can bias said at least one flap in a closed position thereby blocking access to said clearance gap.

8. The safety device of claim 7, wherein said at least one flap comprises a recess for manually moving said at least one flap.

* * * * *